US005325687A

United States Patent [19]

Lin

[11] Patent Number: 5,325,687

[45] Date of Patent: Jul. 5, 1994

[54] CONTROL MECHANISM FOR A DOOR LOCK

[76] Inventor: Jui-Chang Lin, No. 297, Bor-Ay Road, Kaohsiung, Taiwan

[21] Appl. No.: 46,746

[22] Filed: Apr. 15, 1993

[51] Int. Cl.[5] ..... E05B 59/00

[52] U.S. Cl. ..... 70/107; 292/36

[58] Field of Search ..... 70/107; 292/34–36

[56] References Cited

U.S. PATENT DOCUMENTS

| | | | |
|---|---|---|---|
| 3,910,613 | 10/1975 | Nolin | 292/36 X |
| 3,999,789 | 12/1976 | Maurits et al. | 70/107 X |
| 4,156,541 | 5/1979 | Babb, Jr. et al. | 292/34 X |
| 4,183,563 | 1/1980 | Stevens | 292/34 |
| 4,418,552 | 12/1983 | Nolin | 292/34 X |
| 4,709,565 | 12/1987 | Lin | 70/107 |
| 4,838,053 | 6/1989 | Shen | 70/107 X |
| 4,979,767 | 12/1990 | Lin | 292/336.3 |

*Primary Examiner*—Lloyd A. Gall

*Attorney, Agent, or Firm*—Jacobson, Price, Holman & Stern

[57] ABSTRACT

A control mechanism for a door lock includes an outer cap, an inner cap, a plate fixed in the inner cap, an axle and a tube disposed in the inner cap and extended through the plate and extended toward the outer cap, a slide including a pair of oblong holes engaging with the axle and the tube and slidable relative to the plate. The slide includes two shoulders formed in the upper and lower portion and a pair of protrusions extended toward the plate, and a coupling device engaged between the tube and the axle for coupling the tube and the axle together.

3 Claims, 3 Drawing Sheets

CONTROL MECHANISM FOR A DOOR LOCK

BACKGROUND OF THE INVENTION (a) Field of the Invention

The present invention relates to a control mechanism, and more particularly to a control mechanism for a door lock which includes a compact configuration.

(b) Description of the Prior Art

A typical door lock is disclosed in U.S. Pat. No. 4,979,767 to Lin, issued Dec. 25, 1990; and another typical door lock is disclosed in U.S. Pat. No. 4,709,565 to Lin, issued Dec. 1, 1987. Both of the door locks comprise a control mechanism which includes a complicated configuration, this is adverse for manufacturing purposes.

The present invention has arisen to mitigate and/or obviate the afore-described disadvantages of the conventional door locks.

SUMMARY OF THE INVENTION

The primary objective of the present invention is to provide a control mechanism for a door lock which includes a simplified configuration and can be easily manufactured.

In accordance with one aspect of the present invention, there is provided a control mechanism for a door lock comprising an outer cap, a lock mechanism and a first knob provided in the outer cap, an inner cap, a second knob and a third knob provided in the inner cap, a plate fixed in the inner cap, the second knob including an axle extended through the plate and extended toward the outer cap, a shaft coupled between the first knob and the third knob, the third knob including a tube extended through the plate and extended toward the outer cap, a slide including a pair of oblong holes engaging with the axle and the tube respectively and slidable relative to the plate, a resilient member engaged on the axle and secured to the plate for positioning the axle, biasing means coupled between the plate and the slide for biasing the slide to move relative to the plate, the slide including a lower shoulder and an upper shoulder formed in an upper portion thereof and including at least one protrusion extended toward the plate, the axle including a first disc and a second disc engaged thereon and rotated in concert therewith, the first disc including a pair of first shoulders formed thereon and the second disc including a lug extended therefrom for engaging with the lower shoulder and the upper shoulder of the slide respectively, and the tube including a third disc engaged thereon and engaged on the shaft, the third disc including at least one extension and a projection extended outward therefrom for engaging with the protrusion of the slide, whereby, the tube and the axle are coupled together via the slide.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
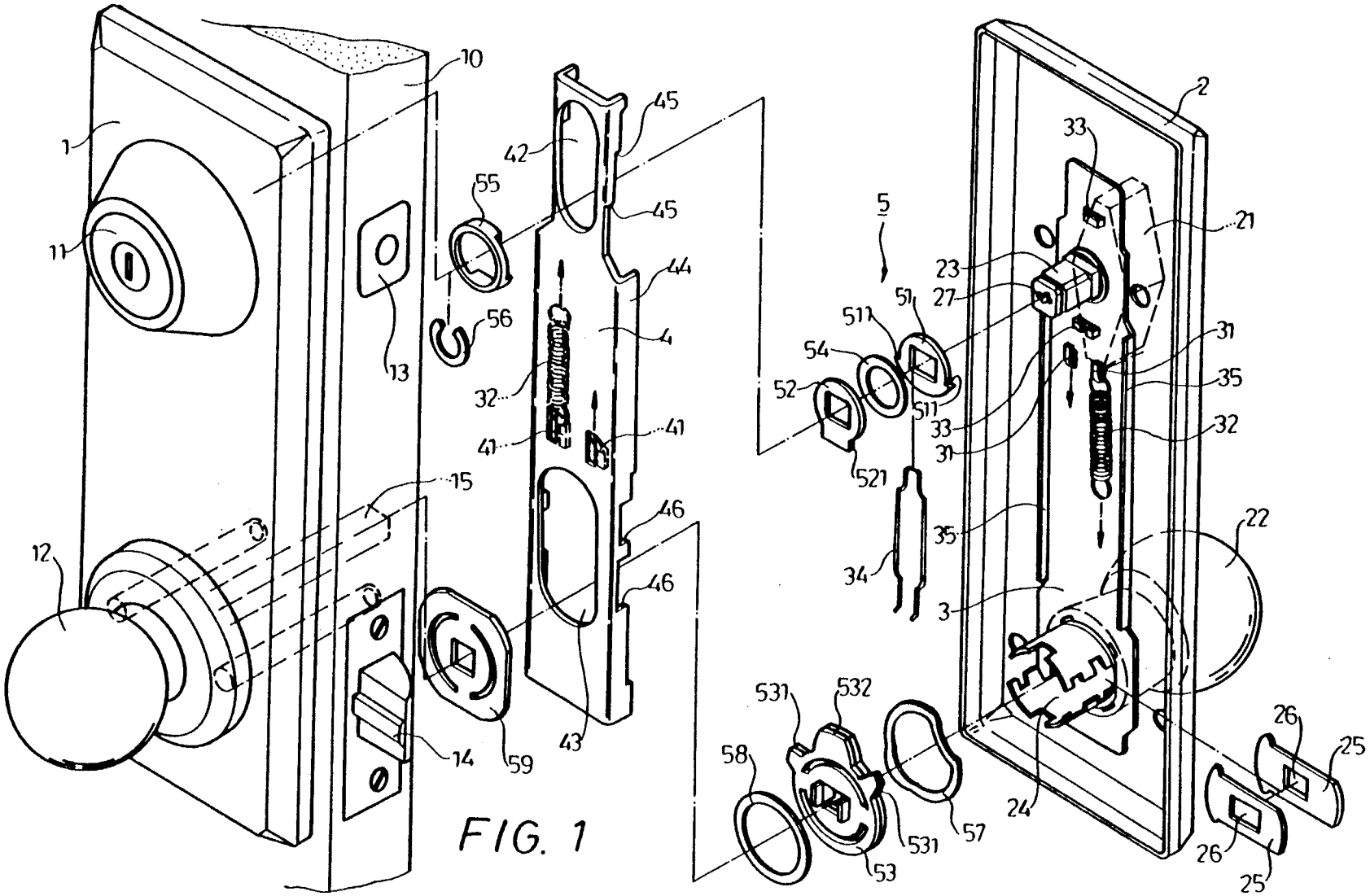
FIG. 1 is an exploded view of a control mechanism for a door lock in accordance with the present invention.
Figure 2:
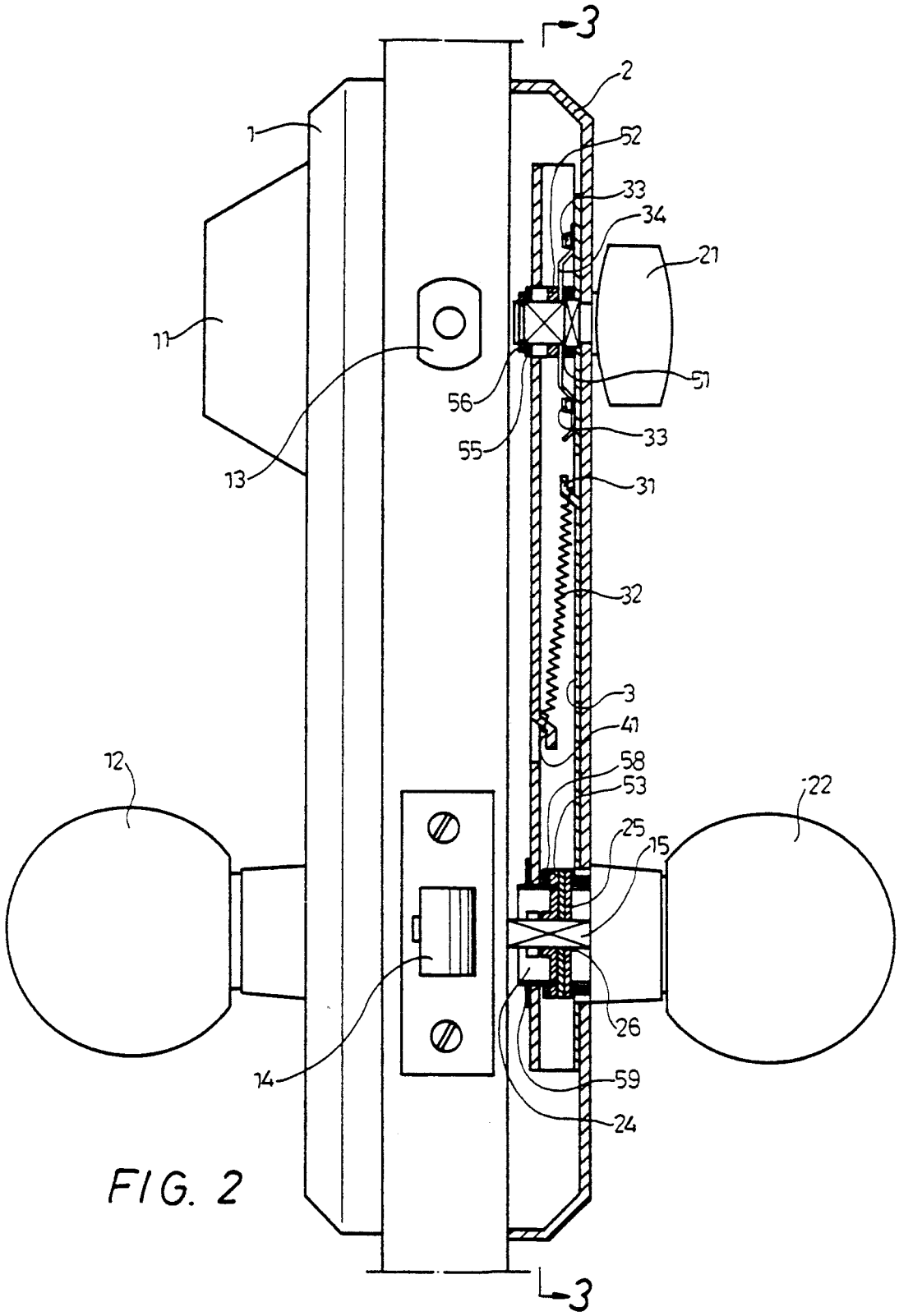
FIG. 2 is a partial cross sectional view of the control mechanism of the door lock.
Figure 3:
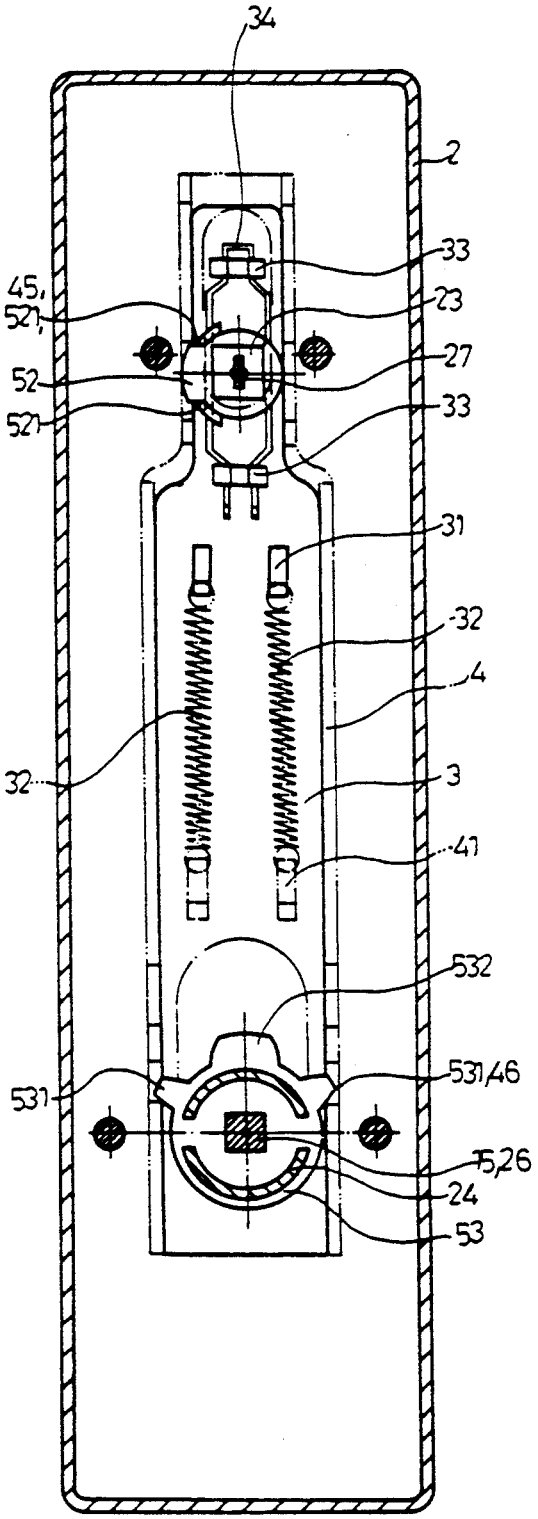
FIGS. 3 and 4 are cross sectional views taken along lines 3—3 of FIG. 2, illustrating the operations of the control mechanism of the door lock.

Referring to the drawings and initially to FIGS. 1, 2, and 3, a control mechanism for a door lock in accordance with the present invention comprises generally an outer cap 1 fixed on the outer portion of the door 10, an inner cap 2 fixed in the inner portion of the door 10, a lock mechanism 11 and a knob 12 secured in the outer cap 1, a knob 21 and a knob 22 provided on the inner cap 2, and two latches 13, 14 controlled by the lock mechanism 11, the knob 21 and the knobs 12, 22. A shaft 15 is extended inwards of the door 10 from the knob 12 and has a square cross section, a plate 3 is fixed in the inner cap 2, a slide 4 is slidably received between the caps 1 and 2, and slidable relative to the plate 3, and a coupling means 5 coupled to the knob 21.

The knob 22 includes a tube 24 extended inwards of the door 10 through the plate 3, two boards 25 fixed in the tube 24 and each having a square hole 26 formed therein for engaging with the shaft 15 of the knob 12 such that the knobs 12, 22 rotate in concert. The knob 21 includes an axle 23 extended through the plate 3 and extended toward the lock mechanism and having a key hole 27 aligned with the lock mechanism such that the key inserted into the lock mechanism 11 may enter into the key hole 27 of the axle 23. Two hooks 31 are provided in the plate 3 for engaging with one end of a spring 32 respectively; two hooks 41 are provided in the slide 4 for engaging with the other end of the springs 32 such that the slide 4 may be biased to slide relative to the plate 3 by the springs 32. A pair of retainers 33 are provided in the plate 3 and located above and below the axle 23 respectively, a resilient member 34 has an upper portion and a lower portion secured to the retaining rings 33 and is engaged on the axle 23 so as to position the axle 23. The plate 3 includes a pair of flanges 35 extended inwards of the door 10.

The slide 4 includes a pair of ribs 44 extended toward the plate 3 for engaging with the flanges 35 of the plate 3 respectively such that the slide 4 can be guided to slide relative to the plate 3. Two oblong holes 42, 43 are formed in the slide 4 for engaging with the axle 23 and the tube 24 respectively. Two pairs of shoulders 45 are formed in the upper portion of the slide 4 and located beside the oblong hole 42, a pair of protrusions 46 are formed in the lower portion of the slide 4 and extended toward the plate 3.

The coupling means 5 includes two discs 51, 52 engaged on the axle 23, a washer 54 engaged between the discs 51, 52, and ring element or spacer 55 engaged on the axle 23 and fixed in place by a retaining ring 56. The disc 51 includes a pair of shoulders 511 formed therein, and the disc 52 includes a lug 521 extended outward therefrom for engaging with the shoulders 45 of the slide 4 respectively. Another disc 53 is engaged on the shaft 15 and engaged in the tube 24, a resilient ring element 57 and a washer 58 are also engaged on the tube 24, and a wall member 59 engaged on the tube 24 for retaining the disc 53 and the boards 25 in place. The disc 53 includes a pair of extensions 531 and a projection 532 extended outward therefrom for engaging with the protrusions 46 of the slide 4 respectively.

In operation, as shown in FIGS. 2 and 3, the knob 21 is in a lock position, i.e., in a vertical position, with both latches 13 and 14 projected at this moment, the lug 521 of the disc 52 is engaged with a lower shoulder 45 of the slide 4 so that the slide 4 is held in an up position relative to the plate 3, and the projection 532 of the disc 53 is extended toward the axle 23, and the extensions 531 of the disc 53 are engaged with the protrusions 46 of the slide 4 respectively.

Figure 4:
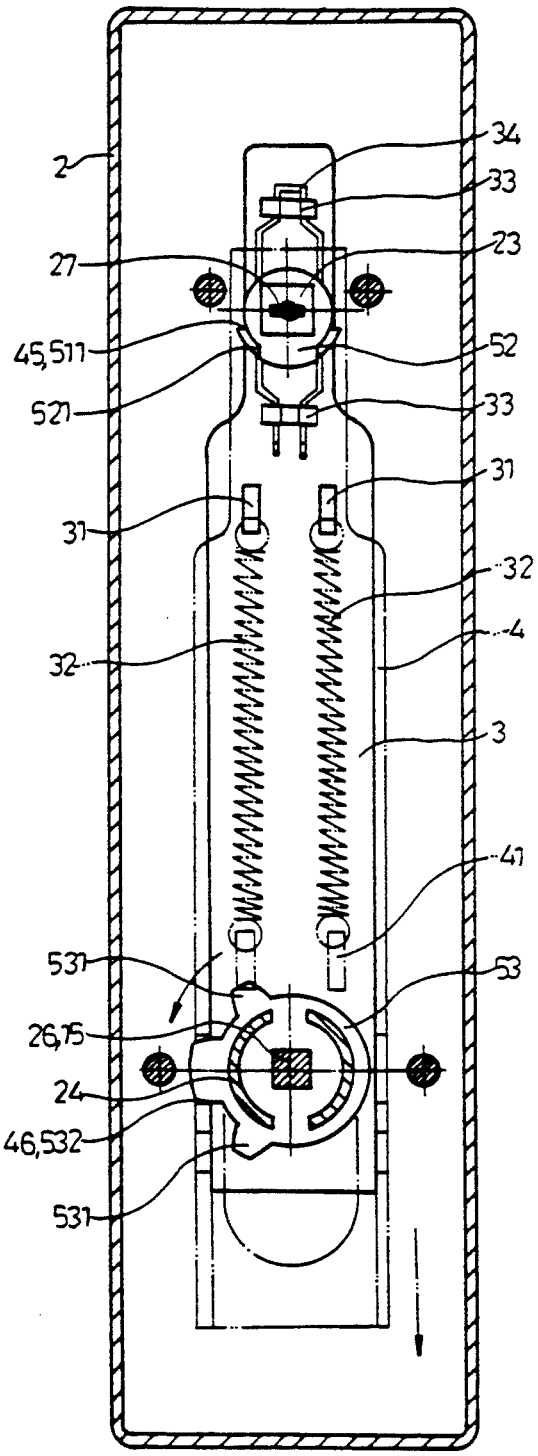

As shown in FIG. 4, when either of the knobs 12, 22 is rotated, the extension 531 and the projection 532 are engaged with a protrusion 46 one after the other and depress the slide 4 downward relative to the plate 3 and against the springs 32; at this moment, the lug 521 of the disc 52 is depressed by a lower shoulder 45 of the slide 4 such that the disc 52 and the axle 23 are rotated whereby the latch 13 is retracted somewhat, the discs 51, 52 are rotated until the shoulders 511 of the disc 51 are engaged with the upper pair of the shoulders 45, the slide 4 is thus prevented from moving further downward relative to the plate 3. At this moment, the axle 23 can be rotated in order to fully retract the door latch 13 either using knob 21 or a key in lock 11. The engagement between the latch 13 and the axle 23 is not related to the present invention and will not be described in further details.

Accordingly, the control mechanism of the door lock in accordance with the present invention includes a simplified configuration and can be easily manufactured.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A control mechanism for a door lock comprising an outer cap, a lock mechanism and a first knob provided in said outer cap, an inner cap, a second knob and a third knob provided in said inner cap, a plate fixed in said inner cap, said second knob including an axle extended through said plate and extended toward said outer cap, a shaft coupled between said first knob and said third knob, said third knob including a tube extended through said plate and extended toward said outer cap, a slide including a pair of oblong holes engaging with said axle and said tube respectively and slidable relative to said plate, a resilient member engaged on said axle and secured to said plate for positioning said axle, biasing means coupled between said plate and said slide for biasing said slide to move relative to said plate, said slide including a lower shoulder and at least one upper shoulder formed in an upper portion thereof and including at least one protrusion extended toward said plate, said axle including a first disc and a second disc engaged thereon and rotated in concert therewith, said first disc including a pair of first shoulders formed thereon for engaging with an upper shoulder of said slide and said second disc including a lug extended therefrom for engaging with said lower shoulder of said slide, and said tube including a third disc engaged thereon and engaged on said shaft, said third disc including at least one extension extended outward therefrom for engaging with said at least one protrusion of said slide, whereby, said tube and said axle are coupled together via said slide.

2. A control mechanism according to claim 1, wherein said tube of said third knob includes a pair of boards engaged therein, each of said boards includes a square hole formed therein for engaging with said shaft, whereby, said first knob and said third knob are coupled together.

3. A control mechanism according to claim 1, wherein said slide has upper and lower protrusions, wherein said third disc includes a pair of extensions, and a projection formed between said extensions, said extensions and said projection of said third disc contact with said protrusions of said slide one after the other when said third knob is rotated.

* * * * *